United States Patent [19]

Yui et al.

[11] 4,253,545

[45] Mar. 3, 1981

[54] ESCAPE DEVICE FOR USE IN MULTISTORIED BUILDINGS

[76] Inventors: Makoto Yui, 509, 18, 2, Uzugamoridai, Higashinada-ku, Kobe city, Hyogo; Katsuyuki Sadakane, 403, 33, 8 Chaenba-cho, Akashi city, Hyogo; Hidemasa Okazaki, 4765-55, Chaenba, Najio, Shiose-cho, Nishinomiya-city, Hyogo, all of Japan

[21] Appl. No.: 2,081

[22] Filed: Jan. 9, 1979

[51] Int. Cl.[3] ..... A62B 1/08

[52] U.S. Cl. ..... 182/240

[58] Field of Search ..... 254/154, 156, 151, 157; 182/5, 6, 7

[56] References Cited

U.S. PATENT DOCUMENTS

| | | | |
|---|---|---|---|
| 1,117,098 | 11/1914 | Sherman | 254/157 |
| 1,541,590 | 6/1925 | Ryba | 254/157 |

*Primary Examiner*—Reinaldo P. Machado

*Attorney, Agent, or Firm*—Oblon, Fisher, Spivak, McClelland & Maier

[57] ABSTRACT

An escape device for lowering an escapee trapped in the upper stories of a burning building, including a cylindrical casing in which is mounted a rotatable drum having a wire wound therearound with one end attached thereto. The casing is provided with an escapee-supporting member mounted externally thereto and a feed-through hole by which the other end of the wound wire exits the casing and can be secured to the building. The drum is provided with a gear on the inner peripheral surface thereof, which gear is in meshing engagement with a reduction gear unit also supported within the casing. One gear of the reduction gear unit is mounted on a shaft which also has mounted thereon a brake disc member. Brake arms having brake shoes facing the brake disc member are mounted exterior to the casing and are manually operable to control the rotation rate of the reduction gear unit, and therefore of the rotating drum, whereby the descent rate of an escapee supported in the escape member attached to the cylindrical casing is safely controlled.

2 Claims, 4 Drawing Figures

ESCAPE DEVICE FOR USE IN MULTISTORIED BUILDINGS

BACKGROUND OF THE INVENTION

1. Field of the Invention

This invention relates to an escape device for use in a multistoried building, which device allows free adjustment of the descending speed during an escape, and is easily assembled and disassembled, light weight, and compact in size.

2. Description of the Prior Art

Recently, there has arisen a tendency for buildings such as warehouses, apartment houses, and office buildings in an urban area to be constructed of multiple stories and generally with increased height. Despite the provision of emergency devices such as emergency stairs and the like in specific positions in a building, the lives of many people are jeopardized in the event of fire, and in the worst case, the loss of lives results.

Meanwhile, as the architectural technology progresses, non-inflammable materials have been developed as interior finish work materials. However, the entire inner surfaces of a building are not necessarily covered with the materials of this type, while inflammable materials still find a wide application as interior-finish materials. As a result, in an emergency such as a fire, the fire tends to spread quickly throughout the building, and a large volume of smoke fills the building, and thus the priecemeal employment of non-inflammable building material results in the failure to ensure the safety of the people habitating the building.

For this reason, many escape devices have been proposed for safely allowing people to escape from a building to the ground. However, these attempts have been unsuccessful in solving these problems in the practical application, because of the complexity in construction and difficulty in assembly, disassembly and the like.

SUMMARY OF THE INVENTION

Accordingly, it is the object of this invention to provide a novel escape device for use in multistoried buildings which permits safe evacuation of a burning building.

Another object is to provide a novel escape device whereby an escapee can escape from the upper stories of a building while concurrently and safely controlling his escape speed.

Yet another object of this invention is to provide a novel escape device which is lightweight, compact and easily assembled and disassembled.

These and other objects are achieved according to the invention by providing an escape device for use in multistoried buildings which includes a cylindrical hollow casing having an escapee-supporting member secured thereto. A drum is rotatably supported by the side walls of the casing by means of bushings disposed internally therein, and is provided with an internal gear on its internal peripheral surface, and an escape wire wound around the outer peripheral surface of the drum. The wire has one end connected to the drum, while the other end thereof is fed through a hole in the cylindrical wall of the casing and attached to the building by means of a hook member attached thereto. A reduction gear unit consisting of two or more gears and is supported in bearings which are fitted on the side walls of the cylindrical hollow casing. One of these gears meshes with the internal gear of the drum, with one end of a shaft for any one of gears in the gear unit being projected from one of the side walls of the casing outwardly. Rotation-braking means including a disc member is secured to this projecting end of the gear shaft, whereby the escapee can control his rate of descent.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
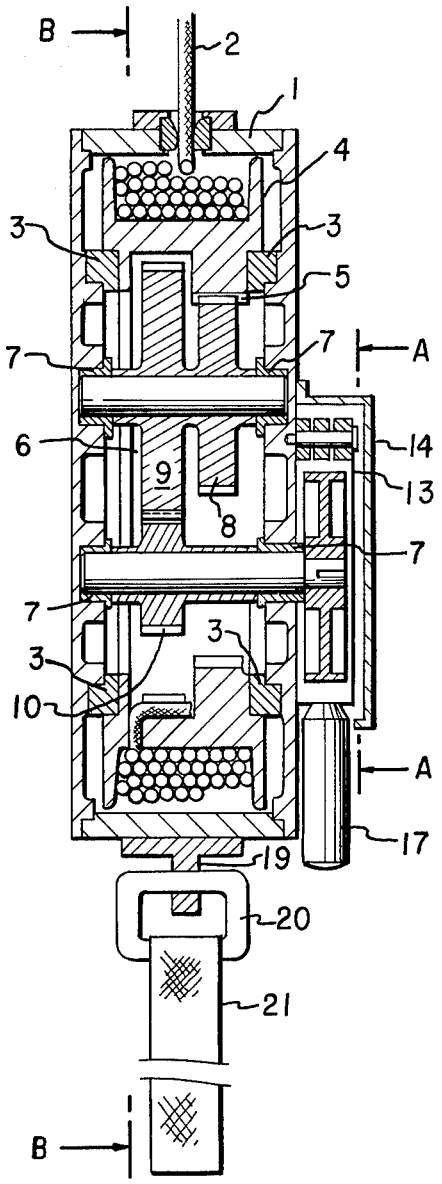
FIG. 1 is a longitudinal cross-sectional view of one embodiment of the invention.

Referring now to the drawings, wherein like reference numerals designate identical or corresponding parts throughout the several views, and more particularly to FIG. 1 thereof, it is seen that the escape device of the invention includes a cylindrical casing in which is provided bronze, looped plain bushings 3 on the inner surface of the side walls of the cylindrical hollow casing 1. A drum 4 having an internal gear 5 is rotatably supported in the casing 1 through the medium of the plain bushings 3. Escape wire 2 for supporting an escapee is wound around the outer peripheral surface of the drum 4. One end of the wire 2 is secured to the drum 4, while the other end is fed out of the casing 1 through a guide hole 22 provided in the cylindrical wall of the casing 1. A hook 23 is secured to the other end of the wire 2, and adapted to be fastened to a suitable member in a room of a building.

A reduction gear unit 6 (three gear train) is provided within the drum 4, being supported by bearings 7 secured to the side walls of the casing, while a gear 8 thereof is adapted to mesh with the internal gear 5, so that a rotational force of the drum 4 is transmitted, in turn, through the gears 8, 9 and then to a gear 10 forming the gear unit 6, and the sum of moments of rotation of respective gears somewhat resists the rotation of the drum 4. In this example, the gear ratio of the gear 5 to the gear 8 is 2:1, and that of the gear 9 to the gear 10 is set to 2.5:1, so that one full turn of the drum causes the gear 10 to make five turns. However, the gear ratio and number of gears may be determined, depending on the weight of an escapee and a distance from the escapee to the ground.

Figure 2:
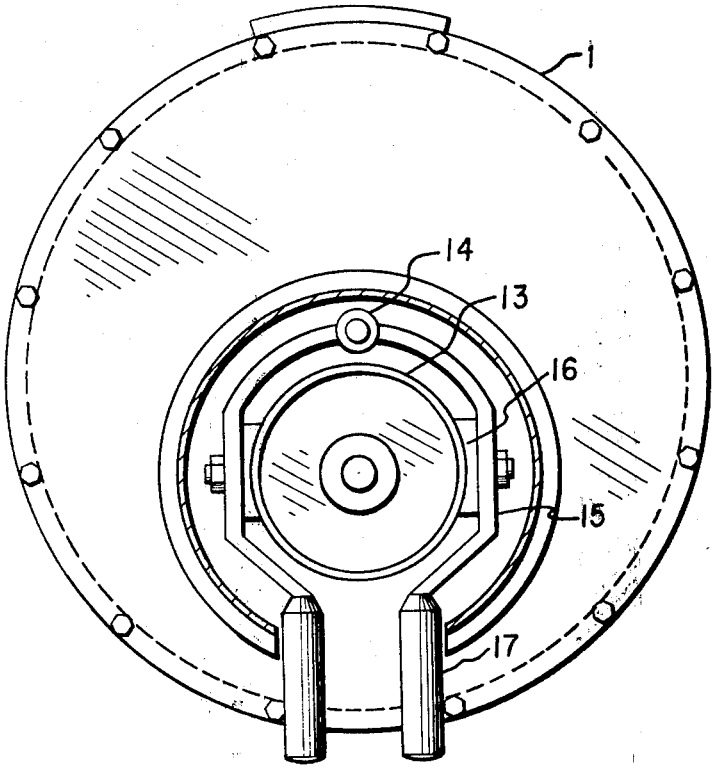
FIG. 2 is a cross-sectional view taken along the line A—A of FIG. 1.
Figures 3A, 3B:
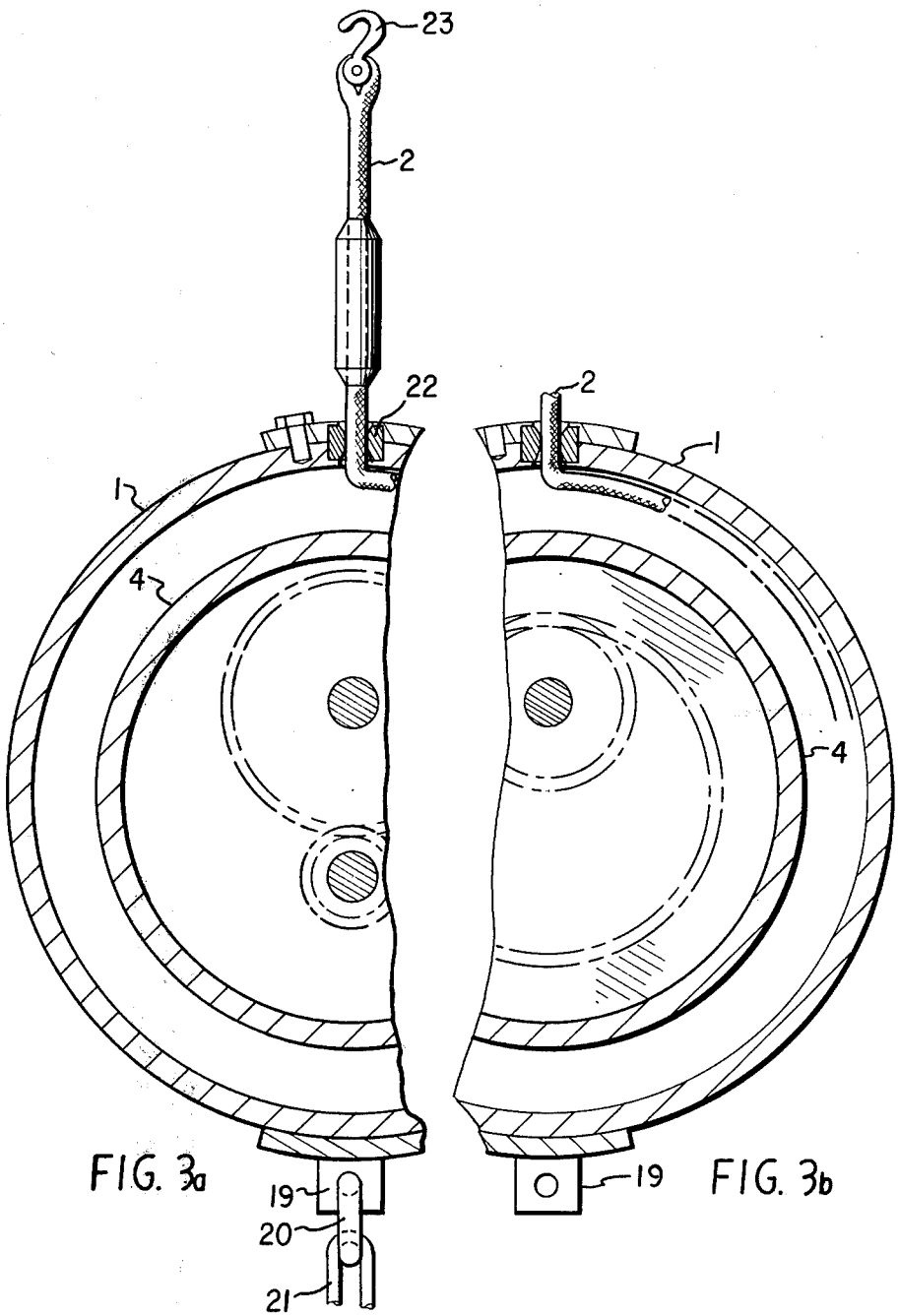
FIG. 3 is a cross-sectional view, half of which is taken along the line B—B of FIG. 1 and given to the left, and the other half of which is taken along the line C—C of FIG. 1 and given to the right.

One end of a shaft for the gear 10 projects from the side wall of the casing outwards, while a disc 13 is secured on the aforenoted projecting end of the shaft. Brake shoes 16 are adapted to contact the outer peripheral surface of the disc 13, and the brake shoes 16 are secured to the inner surfaces of a pair of steel brake arms 15 by means of bolts as shown in FIG. 2. The arms 15 are pivotally supported on a shaft 14 at each one end thereof, while the other end of each arm 15 is formed with a grip 17, so as to facilitate manually squeezing the grips together. Secured to the lower end of the casing 1 is a hoook member, while an escape belt 21 for supporting an escapee is coupled to the hook member through the medium of a ring 20.

In operation of the escape device according to the present invention, an escapee first fastens the escape belt 21 around the body of the escapee, and then the hook 23 secured to one end of the wire 2 is hooked to a suitable member in a room of a building. The escapee is now ready for a descending operation.

In the initial phase of the descending operation, the speed of a descending escapee remains within a safe descending speed range, because of potential energy, so that the escapee may descend slowly. However, as the descending distance is increased, then the descending speed is increased proportionally. In such a case, the escapee manually grips the grips 17, 17 so as to apply a braking force to the disc 13 to control its rotation, i.e., the descending speed of the escapee. As is apparent when the escapee grips the grips 17, 17 strongly, then the descending speed of the escapee is increasingly slowed down. The braking force acting on the disc by means of the grips 17, 17 is positively sequentially transmitted from the gears 10, 9, 8 and then to the drum 4, so that the escapee may adjust the descending speed suitably, within a safe descending speed range, until the escapee reaches the ground.

As has been described earlier, the number of gears included in the reduction gear unit and the gear ratios thereof may be suitably selected, commensurate to the weight of an escapee, the descending distance and the allowable safe-descending-speed range. In addition, the types and dimensions of respective members constituting the escape device according to the present invention may be suitably selected, commensurate to the strength required.

As is apparent from the foregoing description of the escape device according to the present invention, the drum having a descending wire wound around its outer peripheral surface is positioned internally of the casing. Then a reduction gear unit consisting of two or more gears is placed inside the drum in a manner that either one of gears in the reduction gear unit may mesh with the internal gear formed on the inner peripheral surface of the drum. Then one end of a shaft for either one of the gears of the reduction gear unit is projected from the side wall of the casing outwards, and a rotation-braking means including a disc member is secured to the aforenoted projecting end of the shaft. As a result, a braking force may be positively transmitted from the braking means to the drum, so that an escapee may descend, while controlling the descending speed due to the provision of the aforenoted braking means. Thus, the descending speed of an escapee may be adjusted by the escapee, in safety and with ease with a minimal amount of fright to the escapee. Furthermore, once lubricant is supplied to suitable positions of rotating members, then the escape device may be ready for operation at any time, even after a long period of storage. Yet furthermore, the escape device is light in weight and compact in size, thereby facilitating the handling, assembly and disassembly thereof.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An escape device for use in multistoried buildings, comprising:

a hollow cylindrical casing having opposed side walls spaced apart by a cylindrical wall in which is provided a feedthrough hole;

an escapee-supporting member attached externally to said cylindrical casing;

a drum rotatably supported within said cylindrical casing by said cylindrical casing side walls by means of bush members disposed on said side walls, said drum having an internal gear on the inner peripheral surface thereof;

an escape wire wound around the outer peripheral surface of said drum, said wire having one end connected to said drum and the other end fed through said feed-through hole in the cylindrical wall of said cylindrical casing;

a reduction gear unit comprising at least two gears positioned within said drum and within said cylindrical casing and supported in bearings fitted on said casing side walls, one of said at least two gears in mesh engagement with said internal drum gear, the other of said at least two gears mounted on a shaft projecting outwardly from one of the side walls of said cylindrical casing;

single rotation braking means coupled to said shaft for reducing the rate of rotation of said shaft and therefore of said drum, said braking means comprising a disc member secured to said projecting end of said shaft; and, a second casing connected to said cylindrical casing wherein said single rotation braking means is positioned within said second casing.

2. An escape device according to claim 1 wherein said rotation braking means further comprises:

a pair of pivotably supported brake arms having brake shoes on the inner surfaces thereof facing said disc member; and, gripping means attached to said brake arms whereby said brake shoes can be manually forced into contact with said disc member.

* * * * *